US011507123B2

(12) United States Patent
Takada

(10) Patent No.: US 11,507,123 B2
(45) Date of Patent: Nov. 22, 2022

(54) CONSTANT VOLTAGE CIRCUIT

(71) Applicant: ABLIC Inc., Tokyo (JP)

(72) Inventor: Kosuke Takada, Tokyo (JP)

(73) Assignee: ABLIC INC., Tokyo (JP)

( * ) Notice: Subject to any disclaimer, the term of this patent is extended or adjusted under 35 U.S.C. 154(b) by 0 days.

(21) Appl. No.: 16/923,415

(22) Filed: Jul. 8, 2020

(65) Prior Publication Data

US 2021/0011507 A1 Jan. 14, 2021

(30) Foreign Application Priority Data

Jul. 8, 2019 (JP) ..... JP2019-126728

(51) Int. Cl.
*G05F 1/575* (2006.01)
*G05F 1/59* (2006.01)

(52) U.S. Cl.
CPC ..... *G05F 1/59* (2013.01); *G05F 1/575* (2013.01)

(58) Field of Classification Search
CPC ..... G05F 1/462; G05F 1/465; G05F 1/468; G05F 1/56; G05F 1/575; G05F 1/562; G05F 1/565; G05F 1/567; G05F 1/569; G05F 1/571; G05F 1/573; G05F 1/5735; G05F 3/10; G05F 3/16; G05F 3/18; G05F 3/185; G05F 3/20; G05F 3/26; G05F 3/30; G05F 3/205; G05F 3/22; G05F 3/24; G05F 3/222; G05F 3/242; G05F 3/225; G05F 3/277; G05F 3/245; G05F 3/247; G05F 3/262; G05F 3/265; G05F 3/267; G05F 1/463; G05F 1/46; G05F 1/461; H01L 27/0207–0211; H01L 27/0883
USPC ..... 323/271–289; 327/541
See application file for complete search history.

(56) References Cited

U.S. PATENT DOCUMENTS 4,142,114 A * 2/1979 Green ..... H03K 17/145 327/536
4,267,501 A * 5/1981 Smith ..... G05F 3/247 330/253
4,375,596 A * 3/1983 Hoshi ..... H03K 17/14 327/541

(Continued)

FOREIGN PATENT DOCUMENTS

EP 0053653 * 6/1982 ..... G05F 3/20
JP 2006-115594 A 4/2006
WO WO 2010144557 * 12/2010

*Primary Examiner* — Kevin J Comber
*Assistant Examiner* — Nusrat Quddus
(74) *Attorney, Agent, or Firm* — Crowell & Moring LLP

(57) ABSTRACT

A constant voltage circuit includes a depletion transistor having a drain, a gate, and a source, the drain connected to a first power supply terminal, and the gate connected to the source, a voltage division circuit connected between the first power supply terminal and an output terminal, a first enhancement transistor having a drain connected to the source of the depletion transistor, a source connected to the output terminal, and a gate connected to an output terminal of the voltage division circuit, a second enhancement transistor having a source connected to the first power supply terminal, a drain connected to the output terminal, and a gate connected to the drain of the first enhancement transistor, and a pull-down element having one end connected to the output terminal and the other end connected to a second power supply terminal.

4 Claims, 3 Drawing Sheets

(56) References Cited

U.S. PATENT DOCUMENTS 4,609,833 A * 9/1986 Guterman ..... G05F 3/247 257/213
4,952,821 A * 8/1990 Kokubun ..... G11C 5/147 327/68
5,208,488 A * 5/1993 Takiba ..... G11C 16/30 326/62
5,721,516 A * 2/1998 Furuchi ..... H03B 5/364 330/277
5,945,821 A * 8/1999 Sakurai ..... G05F 3/247 323/313
6,043,638 A * 3/2000 Tobita ..... G05F 3/247 323/312
6,087,821 A * 7/2000 Kojima ..... G05F 3/262 323/315
6,255,700 B1 * 7/2001 Yoshida ..... H01L 21/823842 257/369
9,425,789 B1 * 8/2016 Maetani ..... G11C 5/147
2003/0174014 A1 * 9/2003 Nakashimo ..... G05F 3/24 327/542
2005/0077885 A1 * 4/2005 Aota ..... G05F 3/245 323/315
2005/0194997 A1 * 9/2005 Murakami ..... H03F 3/45183 327/89
2007/0221996 A1 * 9/2007 Imura ..... H01L 27/0883 257/370
2008/0265856 A1 * 10/2008 Takada ..... G05F 1/565 323/280
2009/0045870 A1 * 2/2009 Imura ..... G05F 1/56 327/543
2011/0234298 A1 * 9/2011 Suzuki ..... G05F 3/24 327/437
2016/0224049 A1 * 8/2016 Umemoto ..... G05F 3/08
2018/0284833 A1 * 10/2018 Yoshino ..... G05F 3/262
2020/0257325 A1 * 8/2020 Sakaguchi ..... G05F 3/24

* cited by examiner

CONSTANT VOLTAGE CIRCUIT

RELATED APPLICATIONS

This application claims priority to Japanese Patent Application No. 2019-126728, filed on Jul. 8, 2019, the entire content of which is incorporated herein by reference.

BACKGROUND OF THE INVENTION

1. Field of the Invention

The present invention relates to a constant voltage circuit.

2. Description of the Related Art

FIG. 3 is a circuit diagram illustrating a conventional constant voltage circuit 300.

The conventional constant voltage circuit 300 includes a power supply terminal 101, a ground terminal 102, an output terminal 103, a Zener diode 311, and a resistor 312.

A voltage higher than the breakdown voltage of the Zener diode 311 is applied between the power supply terminal 101 and the ground terminal 102 of the constant voltage circuit 300. The Zener diode 311 breaks down to generate the breakdown voltage between the both ends. The resistor 312 adjusts the current flowing through the Zener diode 311 to be under a limit.

As described above, the conventional constant voltage circuit 300 supplies a voltage VREF from the output terminal 103 by the application of the breakdown phenomenon of the Zener diode 311. The voltage VREF is generated with reference to a voltage VDD of the power supply terminal 101 (refer to, for example, Japanese Patent Application Laid-Open No. 2006-115594).

SUMMARY OF THE INVENTION

However, the output voltage of the conventional constant voltage circuit 300 such as described above is determined by the breakdown voltage of the Zener diode 311 which the adopted semiconductor process offers.

The present invention aims to provide a constant voltage circuit capable of supplying an arbitrary constant voltage.

According to one aspect of the present invention, there is provided a constant voltage circuit which includes a depletion transistor of a first conductivity type having a drain, a gate, and a source, the drain connected to a first power supply terminal, and the gate connected to the source, a voltage division circuit connected between the first power supply terminal and an output terminal, a first enhancement transistor of the first conductivity type having a drain connected to the source of the depletion transistor, a source connected to the output terminal, and a gate connected to an output terminal of the voltage division circuit, a second enhancement transistor of a second conductivity type having a source connected to the first power supply terminal, a drain connected to the output terminal, and a gate connected to the drain of the first enhancement transistor, and a pull-down element having one end connected to the output terminal and the other end connected to a second power supply terminal. The constant voltage circuit supplies a constant voltage corresponding to a voltage division ratio of the voltage division circuit to the output terminal with reference to a voltage of the first power supply terminal.

According to a constant voltage circuit of the present invention, since the constant voltage circuit has a negative feedback loop constituted by a voltage division circuit, an arbitrary constant voltage can be supplied by adjusting a voltage division ratio of the voltage division circuit.

DETAILED DESCRIPTION OF THE PREFERRED EMBODIMENTS

An embodiment of the present invention will hereinafter be described with reference to the accompanying drawings.

Figure 1:
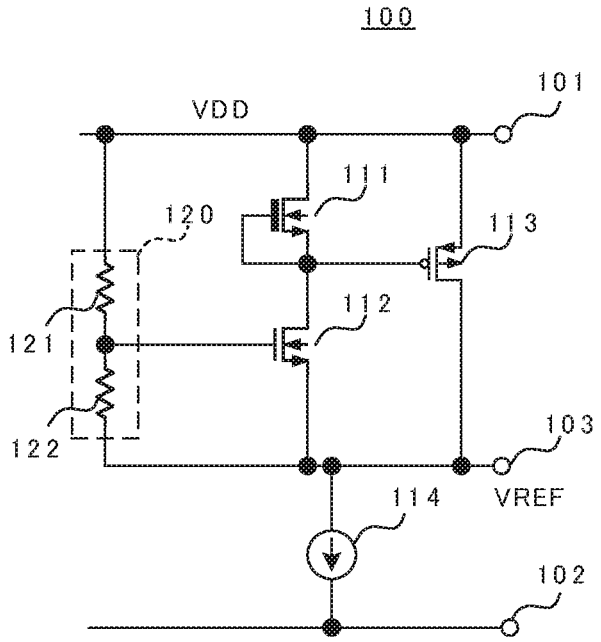
FIG. 1 is a circuit diagram illustrating a constant voltage circuit according to an embodiment of the present invention.

FIG. 1 is a circuit diagram of a constant voltage circuit 100 according to the embodiment of the present invention.

The constant voltage circuit 100 includes a power supply terminal 101, a ground terminal 102, an output terminal 103, a voltage division circuit 120, a depletion type NMOS transistor 111, an enhancement type NMOS transistor 112, an enhancement type PMOS transistor 113, and a pull-down element 114. The voltage division circuit 120 includes a resistor 121 and a resistor 122 connected in series.

The pull-down element 114 is, for example, a constant current circuit as illustrated in the drawing.

A voltage VDD is applied to the power supply terminal 101. The output terminal 103 supplies a voltage VREF.

The resistor 121 has one end connected to the power supply terminal 101 and the other end connected to one end of the resistor 122. The other end of the resistor 122 is connected to the output terminal 103. The NMOS transistor 111 has a drain connected to the power supply terminal 101, and a gate and a source respectively connected to a drain of the NMOS transistor 112 and a gate of the PMOS transistor 113. The NMOS transistor 112 has a gate connected to a connecting point, which is an output terminal of the voltage division circuit 120, of the resistor 121 and the resistor 122 and a source connected to the output terminal 103. The PMOS transistor 113 has a source connected to the power supply terminal 101 and a drain connected to the output terminal 103. The pull-down element 114 has one end connected to the output terminal 103 and the other end connected to the ground terminal 102.

The operation of the constant voltage circuit 100 constituted as described above will next be described.

The voltage division circuit 120 divides a voltage between the power supply terminal 101 and the output terminal 103 and supplies the divided voltage to the gate of the NMOS transistor 112. The NMOS transistor 111 operates as a constant current source because the gate is connected to the source, and supplies a constant current to the NMOS transistor 112. The NMOS transistor 112 operates in such a manner that the larger the voltage between the gate and source becomes, the lower the drain voltage becomes, and contrarily the smaller the voltage between the gate and source becomes, the higher the drain voltage becomes. The PMOS transistor 113 is a source-grounded amplification circuit whose gate is supplied with the drain voltage of the NMOS transistor 112. The pull-down element 114 is provided to supply a minimal current to the voltage division circuit 120, the NMOS transistor 112, and the PMOS transistor 113.

Since a negative feedback loop is constituted by the circuit configuration as shown above, the constant voltage circuit 100 operates to keep the gate-source voltage of the NMOS transistor 112 constant, thereby permitting generation of a constant voltage VREF between the power supply terminal 101 and the output terminal 103.

In the decrease of the voltage VREF under the desired voltage, the potential difference between the two input terminals of the voltage division circuit 120 increases, and the gate-source voltage of the NMOS transistor 112 also becomes large. At this time, since the drain voltage of the NMOS transistor 112 lowers, the gate voltage of the PMOS transistor 113 reduces. e Since the drain current of the PMOS transistor 113 increases, the voltage VREF of the output terminal 103 increases accordingly to the desired value through the negative-feedback control.

In the increase of the voltage VREF above the desired voltage, the potential difference between the two input terminals of the voltage division circuit 120 reduces, and the gate-source voltage of the NMOS transistor 112 also becomes small. At this time, since the drain voltage of the NMOS transistor 112 rises, the gate voltage of the PMOS transistor 113 increases. Since the drain current of the PMOS transistor 113 decreases, the voltage VREF of the output terminal 103 reduces to the desired value through the negative-feedback control.

Now, when the power supply voltage is VDD, the voltage division ratio of the voltage division circuit is $\alpha$, and the gate-source voltage of the NMOS transistor 112 is VGS, the voltage VREF is determined by the following equation:

$$VREF=VDD-\alpha VGS$$

The constant voltage circuit 100 can provide an arbitrary constant voltage VREF by changing the voltage division ratio $\alpha$, i.e., the resistances of the resistors 121 and 122 of the voltage division circuit 120.

Incidentally, the voltage division circuit 120 has been described by taking the example which is constituted from two resistors but may be constituted from three or more resistors.

Although the embodiment of the present invention has been described above, the present invention is not limited to the above embodiment and can be changed in various ways within the scope not departing from the gist of the present invention.

Figure 2:
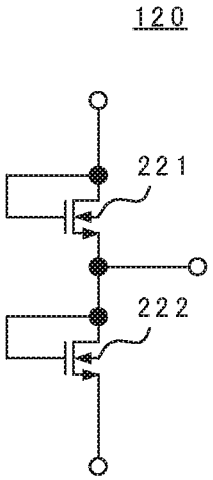
FIG. 2 is a circuit diagram illustrating another example of a voltage division circuit of the constant voltage circuit according to the present embodiment.
Figure 3:
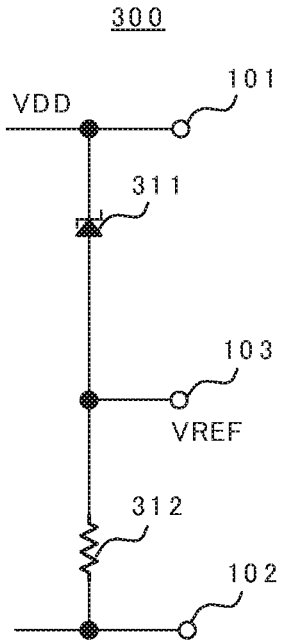
PRIOR ART FIG. 3
FIG. 3 is a circuit diagram illustrating a conventional constant voltage circuit.

For example, although the voltage division circuit 120 has been described to have the resistors 121 and 122 connected in series, a configuration may also be possible in which enhancement type NMOS transistors 221 and 222 are connected in series as illustrated in FIG. 2. Also, the example using the MOS transistors has been described, but bipolar transistors or the like may be used. Further, it is also possible to use an inverted circuit configuration in which PMOS transistors and NMOS transistors are exchanged. Furthermore, the pull-down element 114 only needs have a pull-down function and is not limited to the constant current circuit.

What is claimed is:

1. A constant voltage circuit, comprising:

a depletion transistor of a first conductivity type having a drain, a gate, and a source, the drain connected to a first power supply terminal, and the gate connected to the source;

a voltage division circuit connected between the first power supply terminal and an output terminal;

a first enhancement transistor of the first conductivity type having a drain connected to the source of the depletion transistor, a source connected to the output terminal, and a gate connected to an output terminal of the voltage division circuit;

a second enhancement transistor of a second conductivity type having a source connected to the first power supply terminal, a drain connected to the output terminal, and a gate connected to the drain of the first enhancement transistor; and a pull-down element having one end connected to the output terminal and the other end connected to a second power supply terminal, wherein the constant voltage circuit is configured to supply a constant voltage corresponding to a voltage division ratio of the voltage division circuit to the output terminal with reference to a voltage of the first power supply terminal.

2. The constant voltage circuit according to claim 1, wherein the voltage division circuit comprises a plurality of resistors.

3. The constant voltage circuit according to claim 1, wherein the voltage division circuit comprises a plurality of enhancement transistors.

4. The constant voltage circuit according to claim 1, wherein the second enhancement transistor of the second conductivity type functions as a source-grounded amplification circuit.

* * * * *